United States Patent [19]

Miller

[11] 4,396,814

[45] Aug. 2, 1983

[54] THRESHOLD ADJUSTABLE SAFETY EDGE CONSTRUCTION FOR A MOTOR OPERATED DOOR

[76] Inventor: Bearge Miller, 2-B Governor Markham Dr., Glen Mills, Pa. 19342

[21] Appl. No.: 198,628

[22] Filed: Oct. 20, 1980

[51] Int. Cl.[3] ..... H01H 3/16

[52] U.S. Cl. ..... 200/61.43

[58] Field of Search ..... 200/61.43, 86 R, 86 A

[56] References Cited

U.S. PATENT DOCUMENTS

| | | | |
|---|---|---|---|
| 3,133,167 | 5/1964 | Miller | 200/61.43 |
| 3,260,812 | 7/1966 | Miller | 200/61.43 |
| 3,303,303 | 2/1967 | Miller | 200/61.43 |
| 3,315,050 | 4/1967 | Miller | 200/61.43 |
| 3,321,592 | 5/1967 | Miller | 200/61.43 |
| 3,462,885 | 8/1969 | Miller | 200/61.43 X |
| 3,855,733 | 12/1974 | Miller | 200/61.43 X |
| 3,896,590 | 7/1975 | Miller | 200/61.43 X |
| 4,051,336 | 9/1977 | Miller | 200/61.43 |
| 4,133,365 | 1/1979 | Schleicher | 200/61.43 X |

*Primary Examiner*—J. R. Scott

*Attorney, Agent, or Firm*—Robert B. Famiglio

[57] ABSTRACT

A safety edge switching device for a door wherein a resiliently compressible structure is enclosed by a flexible, impervious sheet covering, and the interior compartment is airtight, forming a pressurized cell, where the pressurization of the cell is user adjustable. A variation of the disclosed invention includes a twin-cell design which provides for additional control uses in safety edge switching functions. Also, a manufacturing method for construction of the invention is disclosed.

3 Claims, 14 Drawing Figures

THRESHOLD ADJUSTABLE SAFETY EDGE CONSTRUCTION FOR A MOTOR OPERATED DOOR

SUMMARY OF THE INVENTION

The device disclosed in the present invention is a safety device for use on an edge of a door such as is generally found in garage doors or elevators. The device is basically of a strip-like design whereas it is easily adapted to existing doors by attachment to the edge, in which some type of travel limit protection is desired. The invention includes a resilient interior fashioned as an electrical switch with foam components encasing the switch. The switching elements in the present invention consists of two metallic strips, separated by an additional foam insulator which is perforated such as to allow electrical contact between the two metallic strips when a compressive force is applied to the strips causing it to collapse.

The present invention further includes a pressure tight containment covering the interior strips of metal, and foam such as to allow the compressive force necessary to collapse the strip to be adjustable. The pressurized containment provides a user an accessable air valve which allows the user to adjust the internal pressure and thus, the amount of force necessary to cause electrical contact between the two internal metal strips.

A variation of the preferred embodiment includes a twin-cell design where there are concentric airtight compartments surrounding the internal metallic contact strips. This design provides for additional control as the outer pressure cell may be used to indicate initial contact with a force. The change in internal pressure within the outer cell provides an indication means for affecting some external control function.

Disclosed with the present invention is a method of manufacture for construction of the airtight cells used in the practice of the invention. A cell construction process which saves manufacturing steps and costs is shown.

It is the object of the present invention to provide a unique, pressure sensitive door edge switch which may be used as a travel limit safety switch on a motorized door such as is found in a garage or elevator.

It is another object of the present invention to provide a pressure sensitive door edge switch which may be used as a safety switch to provide a back-up means to sense overtravel of a given motorized door, such as used in garage doors and the like.

It is also another object of the present invention to provide a door edge safety switch which provides a variable threshold with respect to the required force necessary to cause closure of the internal metallic contacts of the switch.

It is a further object of the present invention to provide a door edge safety switch device which is conformable to an irregular space or shape so as to function as a weather seal.

Another object of the invention is to provide a manufacturing method for the disclosed safety edge design which reduces construction time, manufacturing cost, and increases the integrity and reliability of the seals used to form the airtight cells of the invention.

In one of its aspects, the present invention further functions as a multi-stage, threshold adjustable safety edge switch providing greater control possibilities in on-off switching for motorized door controls.

Other objects and advantages of the invention will become apparent upon reading the following detailed description and upon reference to the drawings.

DETAILED DESCRIPTION OF THE INVENTION

The present invention will now be described with reference to the various drawings wherein like numerals refer to like parts.

Figure 1:
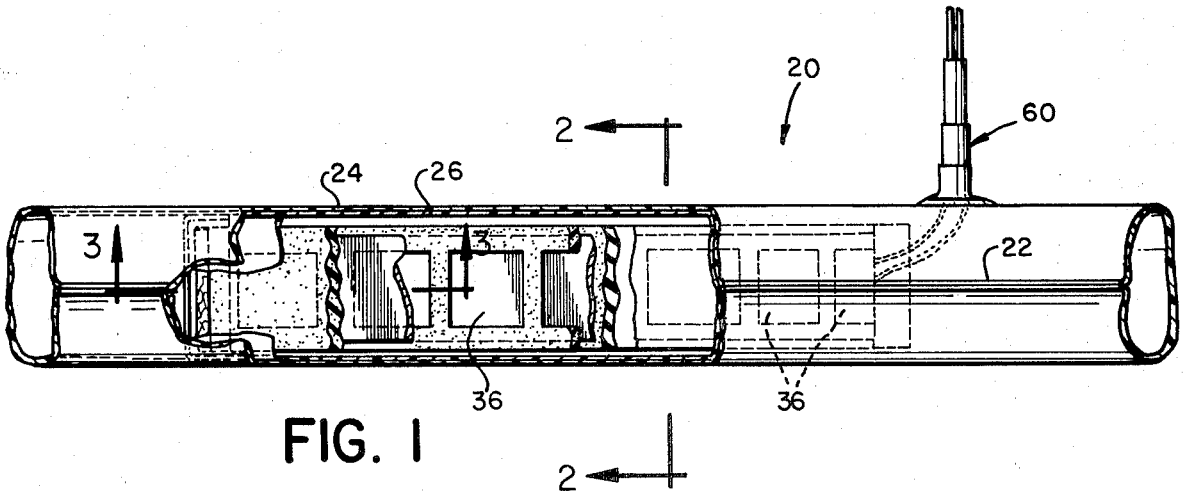
FIG. 1 is a cutaway plan view of a section of the present invention showing a phantom view of the internal layers.

Turning now to FIG. 1, the entire invention is shown in a preferred embodiment as door edge safety switch 20. Switch 20 may be in any length suitable for a particular application, where the criteria would simply be the length of the door edge to be protected. The safety switch 20 is attached to a door edge utilizing flange 22 which extends away from the body of the switch 20 as shown. Flange 22 may be attached by either insertion of same into a slot designed for the purpose of a given door, or by utilizing appropriate brackets which attach between the door and the flange.

Generally, the switch 20 operates by providing an independent means of limit sensing on motorized doors. Should switch 20 be deformed by some normally applied force, internal metallic strips are caused to be in contact with each other in a fashion which may close an electrical circuit. The normally applied force may be, for example, an obstruction in the path of the door as it is being closed. Alternatively, the switch may come into play should a primary limiting means, as the door travels, fail.

Figure 2:
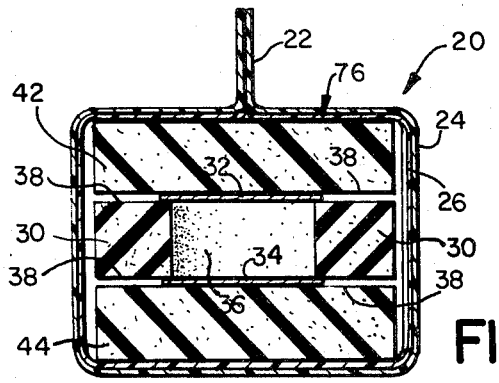
FIG. 2 is a sectional view of the present invention taken along line 2—2 in FIG. 1.

Basic operation of switch 20 may be explained by turning to, particularly, FIG. 2. Here a cross-sectional view of switch 20 clearly shows conductors 32 and 34 at a point along a cross-section in which they are exposed to each other. Also, the various components which comprise the several layers along the cross-section are shown. The interior sections are generally manufactured of resiliently compressible foams which give the switch 20 its volume. Top layer 42 and bottom layer 44 are continuous strips of the above said foam, usually latex, but may be polyurethane or some other suitable foam. These layers serve to maintain the placement of the various internal conductor strips 32 and 34 and the webbed core 30 therein.

The internal conductor strips 32 and 34 likewise extend through the length of the switch 20 and are separated from each other by foam layer 30. As best shown in FIG. 1, layer 30 is of a webbed construction whereas it is composed of intermittent, regularly spaced grids 36 which expose the faces of the upper and lower conductor strips 32 and 34. The internal components above described are covered by outer wall 76 which serves as protection and support for the foam layers heretofore discussed.

In the preferred embodiment, wall 76 is comprised of two individual layers or skins, shown as 24 and 26 in the various figures. Outer layer 24 is manufactured of reinforced polyester, in the preferred embodiment, and is approximately 18 mils in thickness. This outer layer surrounds the internal components completely and is formed from one continuous piece of material, as more fully described later.

Inner layer 26 is fashioned from a similar material, though a thinner gauge material is generally acceptable. The two layers, 24 and 26, comprising wall 76, are not internally bonded to each other. With the exception of the ends and flange, the two layers simply lay against each other and are free to be displaced laterally without the generation of shear stresses between the layers.

The conductive strips 32 and 34 are manufactured from aluminum with a fiber glass layer backing to serve as reinforcement and provide a surface suitable for application of adhesive. Strips 32 and 34 are held in place against center web 30 by adhesive means applied to the corresponding surfaces of the upper and lower foam strips 42 and 44, respectively. The interface between the upper and lower strips, and the center layer 30, utilize an adhesive at 38 to fasten the layers together.

Figure 3:
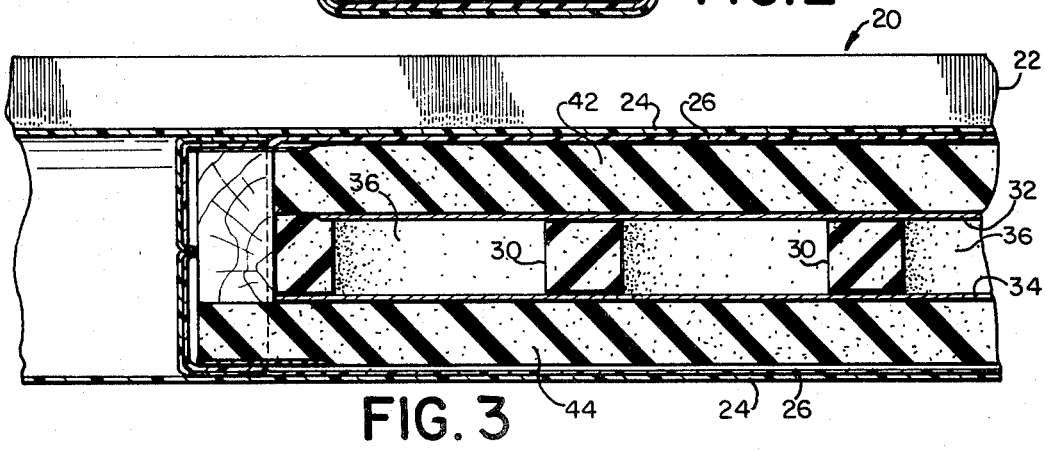
FIG. 3 is a sectional, horizontal view of the present invention taken along line 3—3 of FIG. 1.
Figure 6:
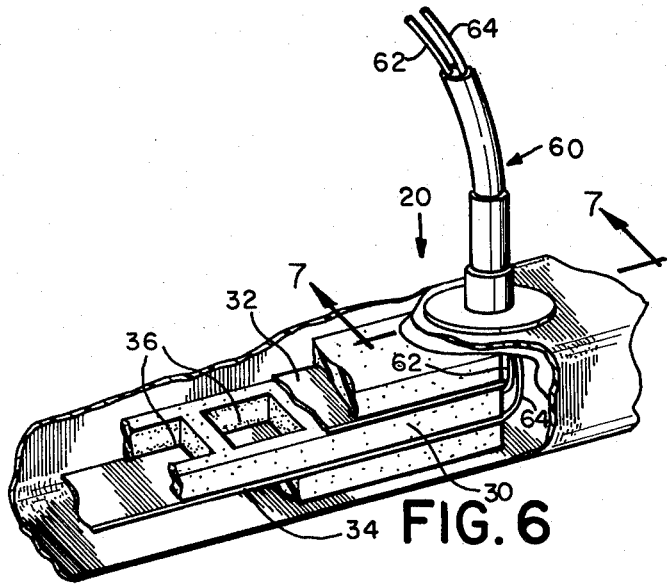
FIG. 6 is a fragmentary perspective view of the present invention further detailing its internal components.

Returning to the basic operation of switch 20, a normally applied force will cause the outer layers of foam, both layer 42 and layer 44, to collapse inward in a fashion which will cause the conductive strips 32 and 34 to be compressed toward each other. As center layer 30 is comprised of spaces 36, as shown in FIGS. 1, 3, and 6, the compressed strips will provide an electrical connection through at least one of the spaces 36. Thus, a basic function is accomplished, as the conductive strips may be connected to an external control mechanism which may be designed to, for example, stop a door being driven by a motor or the like.

Strips 32 and 34 are operatively connected to any external control circuitry via lines 62 and 64. As shown in detail in FIG. 7, the conductive strips 32 and 34 each, individually, are connected to said lines which are each single conductor electrical cables which exit the outer wall 76 via stem 60. Stem 60 serves as protection for the lines exiting the main body of switch 20.

Figure 4:
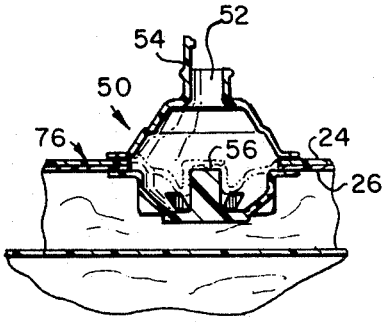
FIG. 4 is a sectional view of the air intake taken along line 4—4 of FIG. 5.
Figure 5:
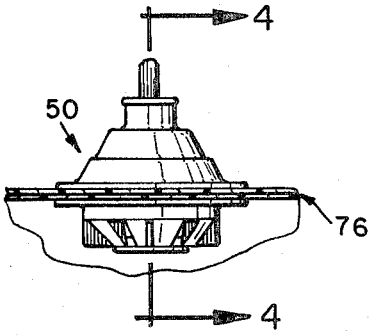
FIG. 5 is a side view of the air intake valve used in the present invention.
Figure 9:
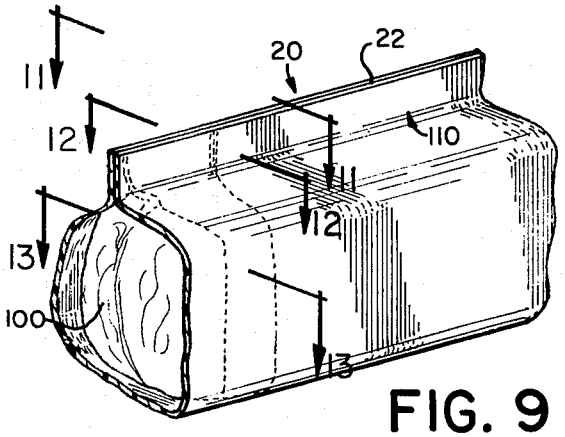
FIG. 9 is a perspective view of the end section of the present invention.
Figure 11:
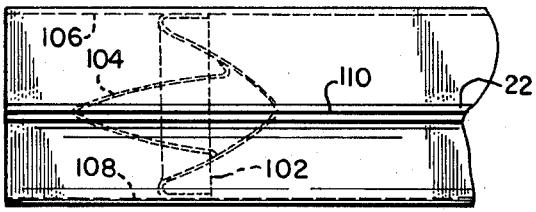
FIG. 11 is a sectional view of the end section encasement taken along line 11—11 in FIG. 9, illustrating the folding method used in sealing the edges in manufacturing the invention.
Figure 12:
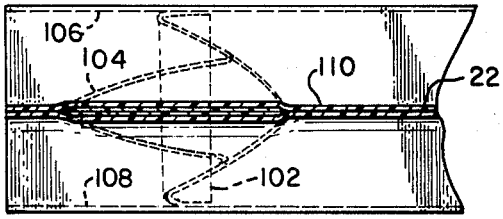
FIG. 12 is a sectional view of the end section encasement taken along line 12—12 in FIG. 9 further illustrating the folding method used in sealing the edges in manufacturing the invention.
Figure 13:
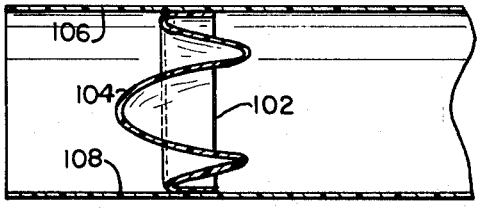
FIG. 13 is a sectional view of the end section encasement taken along line 13—13 in FIG. 9 further illustrating the folding method used in sealing the edges in manufacturing the invention.

Further, in accordance with the invention, wall 76, above described, is sealed in a fashion which causes it to form a pressure tight seal in all seams which may occur in the manufacture. Referring generally to FIGS. 2 and 3, and more specifically to FIG. 9, it will be appreciated that wall 76 is formed around the internal components of switch 20 in a manner which provides for an airtight seal at any location where wall 76 is bonded upon itself during the manufacturing process of switch 20. Further, it will be appreciated that with an airtight encasement about the internal components of switch 20, the internal air pressure with wall 76 may be adjusted so as to vary the rigidity of switch 20, and otherwise adjust the force necessary to compress or collapse the switch to any given distance. Adjustment of this internal air pressure is accomplished by the air intake valve located at a convenient location on wall 76 of switch 20. Turning now to FIG. 5, air intake valve 50 is shown mounted on wall 76 in a fashion which will allow an operator to inflate the internal porous areas of switch 20 within the wall 76. FIG. 4 shows the internal workings of valve 50, and those skilled in the art will readily recognize its operation. Air is blown, or otherwise injected into intake 52 and further passes through secondary intake 56 to pressurize the internal areas within wall 76. Cap 54 is a safety cap used to seal the intake 52 after the pressurization operation is completed. In the preferred embodiment, valve 50 has a pressure locking mechanism at intake 56, which is closed by applying downward pressure on the valve 50. Thus, a major improvement in the operation of safety edge switches is found by the internal pressurization of the unit. As shown in the preferred embodiment, pressurization is user adjustable, hence, allowing on-sight, in operation change of the amount of normal force required for the collapse of switch 20 sufficiently to cause contact of the internal conductors 32 and 34, as above described.

It will be appreciated, by those skilled in the art, that valve 50 may be of a design which allows for coupling of various fixtures commonly used in air injection systems. For example, needle valves and the like, often used for inflation of automobile tires, may be advantageously used to allow simple, hand-operated air pumps to be employed in pressurization of the interior areas of switch 20. It is contemplated that a hand operated pump, such as those used to inflate basketballs, footballs, bicycle tires and the like, which often incorporate air pressure gauges, may be advantageously utilized with the present invention. Utilizing such devices, accurately resettable internal pressures within switch 20, may be achieved as the internal pressure is more easily measured.

Figure 14:
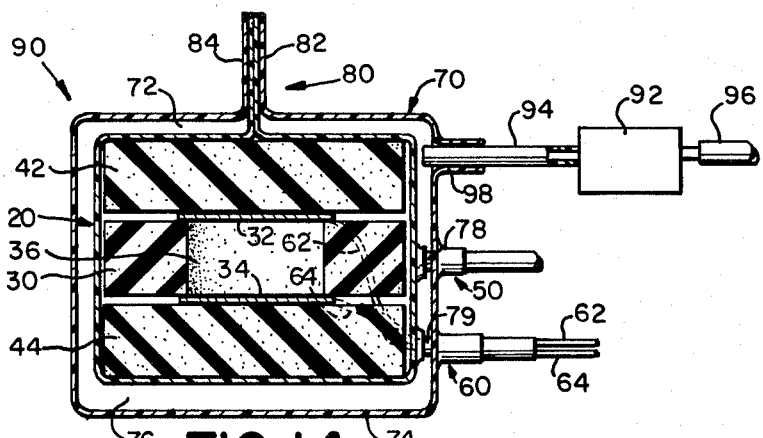
FIG. 14 is a sectional view of a variation of the preferred embodiment of the invention similar to the view shown in FIG. 2, generally taken along line 2—2 in FIG. 1.

Turning now to FIG. 14, a variation of the preferred embodiment described above is shown. FIG. 14 is a sectional view of the invention whereas an additional covering 70 encloses the original switch 20. Switch 90 includes an additional air cell surrounding switch 20, as shown, such as to provide a space between wall 76 and wall 70, at 72. The advantages in the present arrangement are found in the fact that any external force applied to switch 90 will cause the air pressure within space 72 to increase sharply. It will be appreciated that, on consideration of the drawings, pressure increase within space 72 will develop long before conductive strips 32 and 34 are caused to contact each other due to any normally applied external force.

Pneumatic line 94 is sealed at 98 and protrudes into space 72 so as to transmit any change in the pressure found in space 72 to pneumatic switch 92. Switch 92 operates upon the change of pressure presented to it by line 94, and is of a type commonly found and used for this purpose, which is well known to those skilled in the art. Switch 92 is of the type which causes electrical contact closure within, and cable 96 contains the electrical wires used to control some external apparatus, such as a motor, or the like. It is contemplated that the invention shown as switch 90 will be useful in providing additional control information via switch 92 to provide sequenced switching of, for example, garage door motors, so that a large door which consists of a large inertial mass may be accelerated or decelerated in a given direction before it has substantially completely made contact with a given limit, such as a floor, or other obstructions. The conductive strips 32 and 34 function in a manner as previously described for switch 20 alone. Thus, switch 90 functions as a two stage switch which provides greater control and sequencing possibilities than a one stage device alone.

A further application for switch 90 would be found in an environment where the presence of electrical switching components may present a danger. For example, the use of switching contacts, such as formed by strips 32 and 34, present a danger of an explosion in an area where fuel vapors may be present. These conditions may be found in a chemical refinery or aircraft hanger, for example. In these scenes, it will be appreciated that a pneumatic switching operation is preferable to electrical switching, which may cause an arc, thus perhaps, an explosion. In such a situation, pneumatic sensing, as described for switch 90, may be utilized alone without placing any electrical voltage across strips 32 and 34. Switch 92 may be placed away from the area where switch 90 is located. This is possible as line 94 may be of any convenient length so as to permit switch 92 to be located outside of any explosive environment. Thus, switch 90 has several applications for the dual sensing scheme described herein.

It is important to note that switch 90 utilizes the same internal pressurization system as described for switch 20. Considering FIG. 14 further, it should be noted that valve 50 protrudes through to wall 76 so as to provide pressurization to the internal areas within switch 20. Valve 50 extends through wall 74 at seal 78 which is an airtight collar so as to maintain the pressure integrity of space 72.

Figure 7:
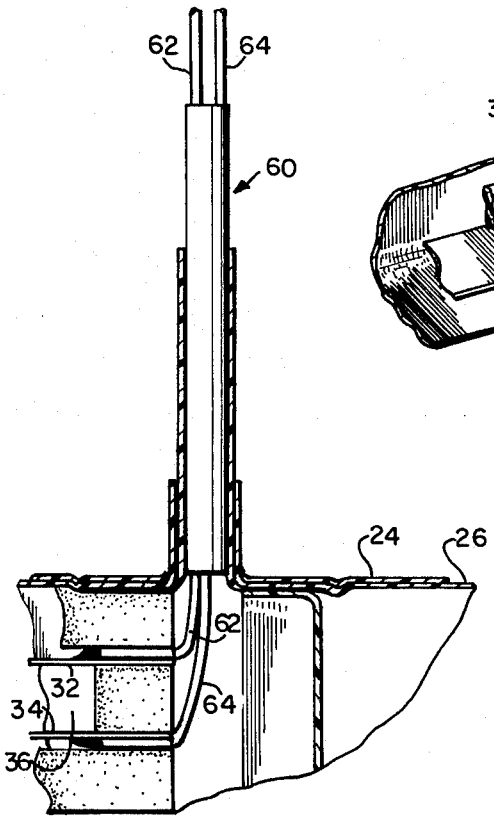
FIG. 7 is a sectional view of the present invention along line 7—7 in FIG. 6 showing the detail of the control wire exit duct and the internal electrical wire connections.

Similarly, it should be noted that control wire stem 60 is sealed securely about collar 79 at wall 74 and protrudes into wall 76 in a fashion similar to that shown for switch 20 alone, in FIGS. 6 and 7.

The support flange 80 for switch 90 supports both the internal switch 20 and the outer assembly enclosed by 70. As shown in FIG. 14, flange 84 is formed from wall 76 of switch 20, while flange 82 is formed over 84, being part of wall 74. The sealing process utilized in forming the seals in flange 80 cause both flange 82 and 84 to be formed welded together, providing for a secure support of the entire structure.

Turning now to FIGS. 8 through 13, a further aspect, and a means to practice the present invention will now be described. As discussed above, the preferred embodiment requires an airtight cell to surround the internal components of the switch 20, or the variations of the preferred embodiment, switch 90.

Figure 8:
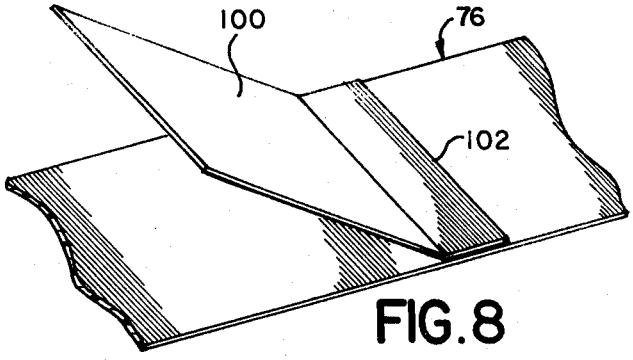
FIG. 8 is a developmental view of the end section encasement of the present invention illustrating a method of manufacture.
Figure 10:
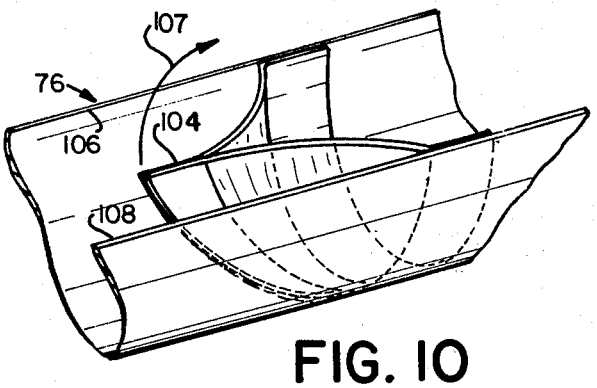
FIG. 10 is a developmental view of the end section encasement of the present invention illustrating a folding step used in the manufacture of the invention.

The wall 76, about the internal components of switch 20, is formed by laying a sheet, of appropriate size, of the PVC material utilized in the invention, in a prone position. Sheet 100, shown in FIG. 8, is then welded in a position as shown. The bonding at 102 is accomplished by radio frequency heating and comprises methods and techniques well known to those skilled in the art. The large sheet comprising wall 76 is thus folded in a manner such as to channel it as best shown in FIG. 10. Simultaneously, sheet 100, which will comprise the end closure of switch 20, is folded accordingly so that it meets upon itself at 104. Fold 104 is brought up to a level where edge 106 and edge 108 of wall 76 are in the same plane.

Fold 104 is then raised vertically outward in the direction indicated by arrow 107 in FIG. 10 such that now fold 104 protrudes above edges 106 and 108.

From this point, a one step sealing process is possible. It will be appreciated that when edges 106 and 108 are brought together, they sandwich the leading edges of sheet 100, generally at fold 104. A one-step welding process, then applied along the top portion of the wall 76, shown as seam 110 in FIG. 9, will provide a seal which is both watertight and airtight and thus, provides the means to practice the invention as an airtight cell as required.

The inherent advantage over the prior art is found in the fact that the sealing along seam 110, thus forming flange 22, is now accomplished in one step. This process eliminates the possibility of pin-hole air leaks about the seams of wall 100, as is the case in conventional sealing processes for similar enclosures. The process thus described eliminates welding steps which would be necessary, and, in fact, are used when wall 100 is a separate, generally square shaped piece which is attached by multi-step welding processes. These processes entail welding along each edge of the square piece used in place in wall 100 in other enclosures, as found in this field of art. Experience has shown that the one-step welding process thus described, and shown in the drawings, provides a greater service lifetime, as the number of separate welds and seams is reduced.

The use of an inflatable cell as described herein has an added advantage of providing a greater flexibility when shipment of switch 20 necessitates folding of same. Prior switch assemblies do not provide a method to reduce or increase the internal air volume of the package. The folding of any such assemblies is difficult or impossible. An advantage of the present invention is found in that valve 50 may be left in an open position such as to allow internal pressure to be released should the volume be compressed in a folding process during packaging for shipment.

Thus it is apparent that there has been provided, in accordance with the invention, a safety edge switching device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A safety edge for a power-operated door, comprising a first elongated generally straight formation of resiliently yieldable material adapted to extend along a door edge, said formation having at least one airtight cell formed by a flexible cover conformably encasing said formation, and adapted for securement to a door; electrical switch actuating means within said airtight cell, said actuating means being operated upon said door closure wherein said straight formation includes:

said switch actuating means comprising two conductive metallic strips disposed internally of said airtight cell, parallel to each other said strip, and oriented to extend along the generally straight formation;

foam strips disposed adjacent to and between said conductive strips, said foam strip between said metallic strips is composed of intermittent grids allowing contact of said metallic strips upon door closure; and said flexible cover encasing said formation compresses inward upon door closure, displacing at least one of said metallic strips to cause switch actuation.

2. The invention in claim 1 wherein further said airtight cell is pressurized by introduction of a pressurizing fluid, by external means, through a valve disposed on and through the said flexible cover and into said airtight cell.

3. The invention of claim 2 wherein a further second flexible cover conformably encases said first elongated generally straight formation, said second cover being similarly airtight and including a means to pressurize the internal area between said second flexible cover and said first flexible cover by introduction of a pressurizing fluid, by external means, through a valve disposed on and through said second cover, further including pneumatic switch actuation means actuated at a given predetermined pressure level existing within the area between said second cover and said first cover.

* * * * *